United States Patent [19]

Evans et al.

[11] Patent Number: 4,928,324

[45] Date of Patent: May 29, 1990

[54] HARD HAT FACE SHIELD BRACKET

[76] Inventors: Jerry Evans, 36 Reynolds Dr., Hampton, Va. 23664; Ravadean Ashely, 58 Linda Dr., Newport News, Va. 23602

[21] Appl. No.: 259,230

[22] Filed: Oct. 18, 1988

[51] Int. Cl.[5] ..... A42B 3/00

[52] U.S. Cl. ..... 2/424; 2/10

[58] Field of Search ..... 2/4, 5, 6, 8, 10, 9, 2/410, 422, 424, 199

[56] References Cited

U.S. PATENT DOCUMENTS

| | | | |
|---|---|---|---|
| 2,421,427 | 6/1947 | Mamlin et al. | 2/5 |
| 2,963,708 | 12/1960 | Herbine et al. | 2/8 |
| 3,114,914 | 12/1963 | Ruggiero | 2/8 |
| 3,548,412 | 12/1970 | Raschke | 2/10 |
| 3,685,054 | 8/1972 | Raschke | 2/10 |
| 4,536,892 | 8/1985 | Brinkhoff et al. | 2/424 |
| 4,547,908 | 10/1985 | Karlsson et al. | 2/424 |

OTHER PUBLICATIONS

Offenlegungsschift No. 2317580, publ. 10-1974, Germany.

*Primary Examiner*—Werner H. Schroeder
*Attorney, Agent, or Firm*—Griffin, Branigan & Butler

[57] ABSTRACT

A channel-shaped member (24) for receiving a front lower rim (14) of a hard-hat face shield bracket (12) in a groove (26) thereof includes a lower flange (56) having an upwardly-directed wall (60) for forming a sump (54) for catching and retaining particles (52) passing about the front lower rim inside the groove.

3 Claims, 1 Drawing Sheet

FIG. 1
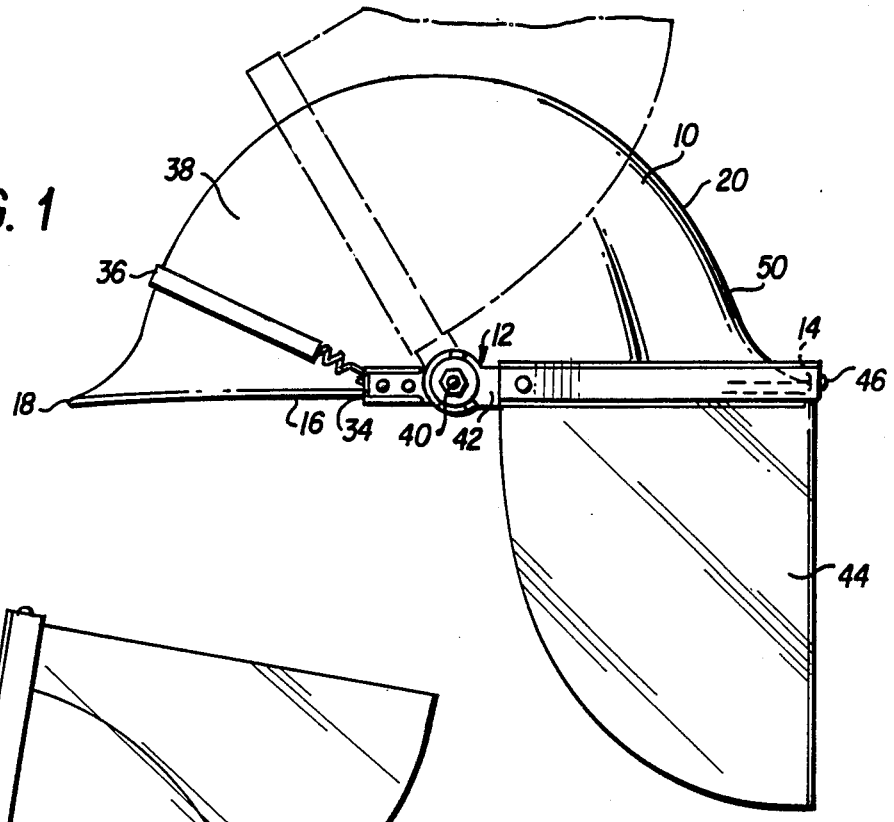
FIG. 2
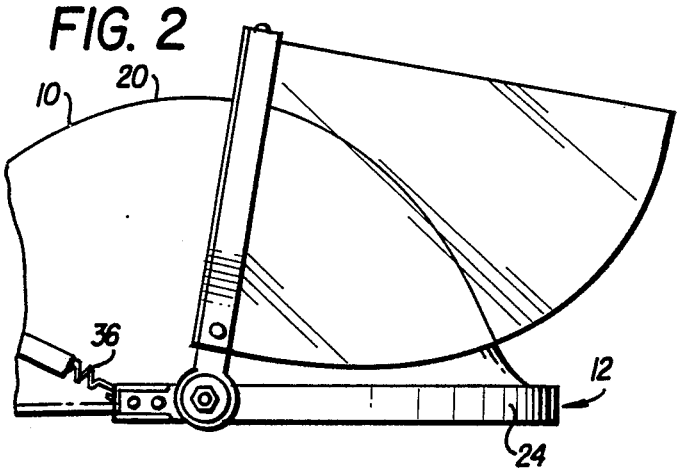
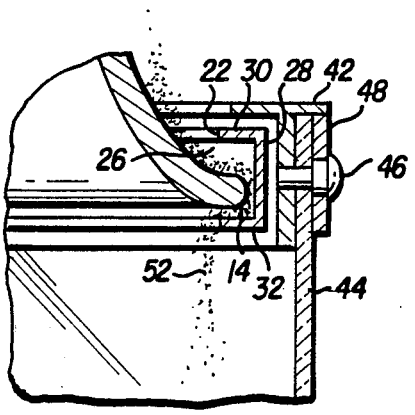
FIG. 3 PRIOR ART
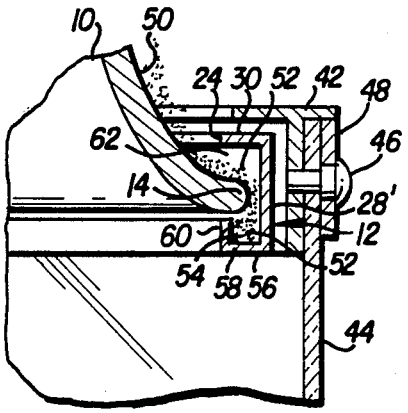
FIG. 4
FIG. 5
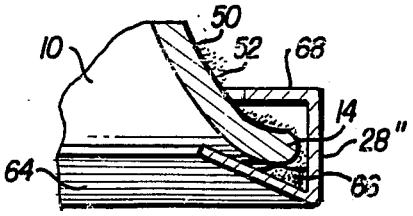

HARD HAT FACE SHIELD BRACKET

BACKGROUND OF THE INVENTION

This invention relates generally to the art of hard hats, and more specifically to brackets used for holding pivotable face shields on hard hats.

Hard hats and face shields have long been used for performing work involving flying particles. In this regard, flying small metal and other particles can easily cause temporary and/or permanent damage to workers' eyes and faces and, for this reason, transparent face masks, or shields, are normally worn by workers around such flying small particles. In addition, workers at most work sites are required to wear hard hats to protect their heads from contact with heavy objects. For this reason, brackets having face shields pivotally mounted thereon have been developed for portably attaching pivotal face shields to hard hats. A typical prior-art bracket includes an elongated, curved, channel member which is placed about the front rim of a hard hat with a groove thereof receiving the front rim. A securing band is attached to rear opposite ends of the channel member for extending about the rear end of the hard hat to pull the channel member against the rim. A face shield is pivotally attached to the channel member. Such an arrangement allows a face shield to be easily mounted on and removed from diverse types of hard hats. However, a major deficiency that such face shield brackets have had is that flying particles striking hard hats, slide down the fronts thereof and fall about the front rims of the hard hats within the channels. These particles eventually fall from the bottoms of the channels, behind the face shields, often into eyes of users thereof. It is an object of this invention to provide a hard hat face shield bracket which does not ordinarily allow particles to travel about the rim of an elongated channel member thereof and fall into the face of a user thereof.

It is also an object of this invention to provide a hard hat face shield bracket which looks and functions substantially in the same manner as those which are already commercially available, but yet which hinders particles from moving about front rims of hard hats and falling behind a face shield into a wearer's face.

It is a further object of this invention to provide a hard hat face shield bracket which is not significantly more expensive than those which are already commercially available, but yet which has the advantages described above.

SUMMARY

According to principles of this invention, an elongated channel-shaped member of a hard hat face shield bracket has a lower flange with an upwardly-directed wall for forming a sump to catch and retain particles passing about a front portion of a hard hat rim inside a groove of the channel-shaped member.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a side view of a hard hat with a face shield bracket of the type with which this invention is used;

FIG. 2 is a segmented view similar to that of FIG. 1 but with a face shield thereof lifted;

FIG. 3 is a cross sectional view of a prior-art hard hat face shield bracket taken at a front rim of a hard hat;

FIG. 4 is a cross sectional view of a hard hat and face shield bracket of this invention also taken at a front rim of a hard hat; and FIG. 5 is a segmented cross sectional view similar to that of FIGS. 3 and 4 showing a channel member on a front rim of a hard hat of an alternate embodiment face-shield bracket of this invention.

DESCRIPTION OF THE PREFERRED EMBODIMENT

FIGS. 1 and 2 depict a hard hat 10 and a face shield bracket 12 mounted thereon. The hard hat 10 has a front rim 14, side rims 16, and a rear rim 18 located at a lower edge of a rounded crown 20.

The face shield bracket 12 is mounted on the front rim 14 by means of an elongated channel-shaped member which for the prior-art embodiment of FIG. 3 is identified by reference numeral 22 and which for a first embodiment of this invention is identified by reference numeral 24 in FIG. 4.

It should be understood that the face shield bracket 12 depicted in FIGS. 1 and 2 could be either a prior-art face shield bracket shown in FIG. 3 or a face shield bracket of this invention shown in FIG. 4. From the drawings of FIGS. 1 and 2, it is not possible to distinguish which of these inventions is depicted with the exception that the channel member shown in FIG. 2 is labeled with reference numeral 24. In the prior-art embodiment of FIG. 3, the elongated channel shaped member 22 defines a continuous groove 26 with a vertical web 28, an upper horizontal flange 30 and a lower horizontal flange 32. In this respect, the prior-art elongated channel shaped member 22 extends completely about the front rim 14 to ends 34 at the side rims 16. These ends 34 are connected to securing band 36 which extends about a back side 38 of the crown 20 to pull the channel shaped member 22 back on the front rim 40 of the hard hat 10 and hold it securely thereon. The channel member 24 has a pivot pin 40 mounted thereon for pivotally mounting a face shield frame 42 to the channel shaped member 22 at about the positions of a wearer's temples. A transparent plastic face shield 44 is mounted to the face shield frame 42 by means of rivets 46 and a retainer 48. Thus, a user of the hard hat 10, with a face shield bracket 12 mounted thereon, can have the face shield 44 pivoted to a down position in which the transparent face shield 44 is in front of his face and eyes as shown in FIG. 1 in solid lines or he can have it pivoted to a raised position as shown in FIG. 1 in dashed lines and in FIG. 2 in solid lines.

When the face shield 44 is in the down position as depicted in FIG. 1, the face shield frame 42 should make a sealing contact with the elongated channel shaped member 22 so as not to allow particles to pass between the channel shaped member 22 and the face shield frame 42. However, a problem which has existed in prior art systems is that work particles often come in contact with a front side 50 of the hard hat 10 and slide down this front side 50 to the front rim 14. Although the front rim 14 is located in the continuous groove 26 of the prior-art elongated channel shaped member 22, the front rim 14 usually does not make good sealing contact with the elongated channel shape member 22. Thus, these particles 52 pass about the front rim 14 in the continuous groove 26 and finally fall behind the face shield 44 as can be seen in the prior-art device of FIG. 3.

The channel shaped member of this invention 24, which is depicted in FIG. 4, includes a continuous sump 54 formed in a lower flange 56. This sump 54 comprises a horizontal portion 58 and an upwardly directed vertical portion 60. By being thusly shaped, the sump 56 catches particles 52 falling down the front side 50 of the hard hat 10 and passing about the front rim 14. In the embodiment of FIG. 4, a vertical web 28' of the channel-shaped member 24 of this invention is slightly longer than the vertical web 28 of the prior-art elongated channel shaped member 22.

In operation, a face shield bracket 12 having a sump on its channeled shaped member 24, as depicted in FIG. 4, is installed on a hard hat 10 in the same manner as are prior-art face shield brackets. That is, the front rim 14 of a hard hat 10 is inserted into the groove 62 and a securing band 36 attached to rear ends of the channel shaped member 24 of this invention is stretched across the backside 38 of the hard hat 10. When a user is wearing the hard hat 10, with a face shield bracket 12 having the channel shaped member 24 of this invention, particles 52 striking the front side 50 of the hard hat 10 roll down the front side 50 and pass about the front rim 14. These particles passing about the front rim 14 fall into the sump 54 and are not allowed to fall further behind the face shield 44. When the user takes off the hard hat 10 he blows or shakes these particles out of the sump 54 so that the sump 54 is empty and can receive additional particles during the next use of the face shield bracket. In this respect, the user can also remove the face shield bracket in order to clean out the sump 54.

FIG. 5 depicts a second embodiment of this invention in which a lower flange 64 forms a sump 66 by being attached to a vertical web 28" so as to be angled upwardly toward an upper horizontal flange 68. Again, particles 52 falling down the front side 50 of a hard hat 10 pass about the front rim 14 and drop into the sump 66. These particles do not fall behind the face shield 44 but rather are cleaned out by a user at the end of a work period.

In a preferred embodiment, the sumps have a depth and width of at least an eight of an inch. However, either of these dimensions could be greater than this.

It can be appreciated by those skilled in the art that the hard hat face shield bracket of this invention is vastly superior to prior-art hard hat face shield brackets because it protects a user's face and eyes from particles which commonly pass about channel shaped members of the prior-art face shield brackets.

While the invention has been particularly shown and described with reference to a preferred embodiment, it will be understood by those skilled in the art that various changes in form and detail may be made therein without departing from the spirit and scope of the invention. For example, the sump of the channel shaped member could take various shapes, however, what is important is that it include a lower flange having an upwardly directed wall and that it be continuous above a wearer's face so that it does not allow particles to fall therefrom into the wearer's face. Also, it is possible to mount the channel shaped member 24 of this invention on the rear rim 18 of the hard hat 10 and to wear the hat backward if it fits better in this manner.

The embodiments of the invention in which an exclusive property or privilege are claimed are defined as follows:

1. A bracket for securing a face shield onto a hard hat of a type having a rigid crown terminating at a front lower-level rim in front of a wearer's head, said bracket comprising:

an elongated channel-shaped member shaped in length generally similarly to the front lower-level rim, said channel-shaped member, when viewed in cross section, having a central vertical web and upper and lower flanges extending laterally from opposite ends of the web to define a continuous groove extending along the length of the channel-shaped member for receiving the front lower-level rim of the hard hat;

securing means for securing the channel-shaped member onto the hard hat with said front lower-level rim thereof being in said continuous groove; and a face shield assembly including a pivot means for pivotally securing a transparent face protective shield to the channel-shaped member at points approximately aligned with temples of the head of wearer of the hard hat and for allowing said protective shield to be pivoted between a position below said hard hat in front of said wearer's head and a position above said hard hat away from the front of the wearer's head;

said lower flange of said channel-shaped member comprising an upwardly-directed wall for forming a continuous sump below the front lower-level rim for catching and retaining particles passing about the front lower-level rim inside said groove;

whereby said particles falling down the hard hat crown and passing about the lower-level rim inside the groove are caught in said sump and thereby prevented from falling in said wearer's face.

2. A bracket as in claim 1 wherein, said sump is rectangular in cross sectional shape.

3. A bracket as in claim 1 wherein, said sump is triangular in cross sectional shape.

* * * * *